United States Patent [19]

Malloy et al.

[11] 4,354,904

[45] Oct. 19, 1982

[54] ELECTROCHEMICAL OXIDATION OF ALKYL AROMATIC COMPOUNDS

[75] Inventors: Thomas P. Malloy, Lake Zurich, Ill.; Mark A. Halter, Columbia, Md.; David W. House, Arlington Heights, Ill.

[73] Assignee: UOP Inc., Des Plaines, Ill.

[21] Appl. No.: 234,516

[22] Filed: Feb. 13, 1981

Related U.S. Application Data

[63] Continuation-in-part of Ser. No. 61,210, Jul. 27, 1979, abandoned.

[51] Int. Cl.[3] ..... C25B 3/02

[52] U.S. Cl. ..... 204/59 R; 204/78

[58] Field of Search ..... 204/59 R, 78

[56] References Cited

U.S. PATENT DOCUMENTS

| | | | |
|---|---|---|---|
| 3,257,298 | 6/1966 | Hughes | 204/59 R |
| 4,046,652 | 9/1977 | Pistorius et al. | 204/78 |
| 4,101,392 | 7/1978 | Hallcher et al. | 204/59 |
| 4,148,696 | 4/1979 | Halter | 204/59 |
| 4,203,811 | 5/1980 | Cramer | 204/59 R |

OTHER PUBLICATIONS

Bulletin of the Chemical Society of Japan, vol. 37, No. 11, (The Homolytic Methoxylation of Aromatic Compounds by the Anodic Oxidation of Methanol—by Tadao Inque et al.).

*Primary Examiner*—Howard S. Williams

*Attorney, Agent, or Firm*—James R. Hoatson, Jr.; Raymond H. Nelson; William H. Page, II

[57] ABSTRACT

Aromatic aldehydes may be prepared by subjecting a methyl-substituted aromatic compound to an electrical energy which includes a direct electrical current utilizing a basic medium to form an acetal, following which the acetal may be converted to the desired aldehyde by subjecting said acetal to acid hydrolysis.

12 Claims, No Drawings

ELECTROCHEMICAL OXIDATION OF ALKYL AROMATIC COMPOUNDS

CROSS-REFERENCE TO RELATED APPLICATION

This application is a continuation-in-part of our copending and now abandoned application, Ser. No. 61,210 filed July 27, 1979, all teachings of which are incorporated herein by reference thereto.

BACKGROUND OF THE INVENTION

Aromatic aldehydes which may be used in a variety of chemical reactions have, in the past, been prepared by various alternate reactions. For example, one method of preparing an aromatic aldehyde has been an air oxidation reaction in an oxygen-enriched environment utilizing relatively high temperatures and pressures in combination with a transition metal catalyst such as cupric bromide. Another method of effecting the preparation of aromatic aldehydes is by the chemical oxidation of the substrate using stoichiometric quantities of an oxidizing agent which is obtained by way of known electrochemical methods using concentrated sulfuric or perchloric acid, said reaction being effected at elevated temperatures. Yet another basic synthetic reaction for obtaining aromatic aldehydes is the chemical oxidation of the substrate using stoichiometric quantities of electrochemically generated oxidants such as salts of cobalt, manganese, or chromium in their highest valence state in a strongly acidic media at elevated temperatures. Reduced oxidant is then recycled, purified and electrolytically reoxidized back to its active state.

The inherent drawback in the last named reaction involves the reoxidation and recycling of the oxidant by electrochemical methods. Heretofore all of the methods which have been employed in this area have oxidized the transition metal to its higher valence state prior to combination of the same with the organic substrate in a conventional chemical reactor. In essence, this comprises a two-step reaction which requires both an electrochemical reactor and a chemical reactor. In addition, the aforementioned processes have utilized relatively concentrated acids such as from 40% to 70% concentration of sulfuric acid or perchloric acid, thus making the selectivities of these processes for activated alkyl aromatic systems less than desirable. The undesirability of these processes results from the tendency of the alkyl aromatic systems towards sulfonation or by-product formation.

Prior work in the oxidation of aromatic compounds has been shown in the U.S. Pat. No. 4,046,652. However, this patent describes the oxidation of an aromatic nucleus in an electrochemical reaction to form p-benzoquinone diketals. The electrolyte which is used in this electrochemical reaction comprises methyl alcohol containing a conducting salt, preferably an ammonium or alkali metal salt of an acid such as hydrofluoric acid, perchloric acid, nitric acid, etc. Likewise, U.S. Pat. No. 4,148,696 also relates to electrochemical oxidation reactions involving aromatic compounds. However, this patent involves an anodic acyloxylation involving the use of a salt of a fatty acid. Another patent, namely U.S. Pat. No. 4,101,392 discloses a process for the electrolytic oxidation of aromatic compounds. However, this patent is concerned with a process for the methyl-methyl coupling of hydroxy aromatic compounds, which process is in contradistinction to the process of the present invention, hereinafter set forth in greater detail, which is concerned with the oxidation of the methyl substituent of a methyl-substituted aromatic compound. An article which appeared in the *Bulletin of the Chemical Society of Japan,* volume 37, number 11, has disclosed an electrochemical process for the methoxylation of aromatic compounds. This anodic oxidation was effected by treating an aromatic compound such as tetralin, indane, or diphenylmethane, to afford a methoxy-substituted aromatic compound. However, this process is dissimilar from the process of the present invention in which the methyl-substituent on the ring of an aromatic compound is converted to an aldehyde.

As will hereinafter be set forth in greater detail, it has now been discovered that the oxidation of an alkyl aromatic compound in an electrochemical reaction may be effected in the presence of a nucleophile to form an acetal which is then converted to the desired aldehyde.

DETAILED DESCRIPTION OF THE INVENTION

This invention relates to a process for the electrochemical oxidation of an alkyl aromatic compound. More specifically, the invention is concerned with a novel electrosynthetic process to form aromatic carbonyl compounds.

Aldehydes which have been formed by the oxidation of alkyl aromatic compounds will find a wide variety of uses in the chemical field. For example, anisaldehyde, and specifically the para isomer, will find uses as a component in perfumes, colognes, scents, etc., and as an intermediate for pharmaceutical compounds such as antihistamines. Likewise, 3-ethoxy-4-hydroxybenzaldehyde which is also known as ethyl vanillin is used in flavors as a replacement or fortifier of vanillin. Another aldehyde which finds an important use in the chemical industry is p-chlorobenzaldehyde which is used as an intermediate in the preparation of triphenylmethane and related dyes as well as for the synthesis of organic chemicals such as pharmaceuticals and medicinals.

It is therefore an object of this invention to provide a process for the electrochemical oxidation of alkyl aromatic compounds.

A further object of this invention is to provide a novel electrosynthetic route to oxidize alkyl aromatic compounds to form acetals which are then converted to the desired aldehydes.

In one aspect, an embodiment of this invention resides in a process for the preparation of an aldehyde comprising subjecting a methyl-substituted aromatic compound to an electrical energy including direct electric current in an electrochemical cell in the presence of a nucleophile in a basic medium at reaction conditions to form an acetal, thereafter subjecting said acetal to acid hydrolysis, and recovering the resultant aldehyde.

A specific embodiment of this invention is found in a process for the preparation of an aldehyde which comprises subjecting p-methoxytoluene to an electrical energy which includes a voltage in the range of from about 2 to about 3 volts at a current density in the range of from above 0 to about 1000 milliamps per square centimeter in a medium comprising methyl alcohol in the presence of a nucleophile comprising sodium methoxide and a reaction initiator comprising sodium hydroxide, said treatment being effected in an electrochemical cell at a temperature in the range of from about ambient to about 50° C. and atmospheric pressure to form p-anisaldehyde dimethyl acetal, thereafter subjecting said acetal to acid hydrolysis and recovering the desired p-anisaldehyde.

Other objects and embodiments will be found in the following further detailed description of the present invention.

The present invention is concerned primarily with a novel electrosynthetic route to form aromatic carbonyl compounds by the electrochemical oxidation of an alkyl aromatic compound, said alkyl aromatic compound possessing at least one benzyl methylene or methyl moiety on the nucleus thereof. The electrosynthesis of an alkyl aromatic compound of the type hereinafter set forth in greater detail involves the anodic benzyl oxidation of the compound in the presence of a nucleophile to form an ether or an acetal. Following the formation of the acetal, the compound may then be subjected to a subsequent acid hydrolysis procedure in order to obtain the desired carbonyl compound such as an aldehyde. The electrochemical oxidation is effected in an electrochemical cell which may be a divided electrical cell using suitably chosen electrodes and an environmentally stable anion exchange membrane or, if so desired, it may also be effected in a standard electrolytic cell which is not divided.

By utilizing the process of the present invention, it is possible to effect the desired reaction in a process which requires only product separation with no need for concurrent electrolyte purification, thus utilizing a significantly less corrosive and industrially feasible medium with the concurrent advantages of low by-product formation and lower overall processing costs.

The alkyl aromatic compounds which are used as starting materials for the electrochemical oxidation process of this invention and which possess a methyl substituent in the ring will include toluene, o-hydroxytoluene, m-hydroxytoluene, p-hydroxytoluene, o-methoxytoluene, m-methoxytoluene, p-methoxytoluene, o-ethoxytoluene, m-ethoxytoluene, p-ethoxytoluene, o-propoxytoluene, m-propoxytoluene, p-propoxytoluene, o-butoxytoluene, m-butoxytoluene, p-butoxytoluene, 1,2,3-trimethylbenzene, 1,3,5-trimethylbenzene, 1,2,4-trimethylbenzene, 1,2,3,4-tetramethylbenzene, pentamethylbenzene, o-ethyltoluene, m-ethyltoluene, p-ethyltoluene, o-n-propyltoluene, m-n-propyltoluene, p-n-propyltoluene, o-isopropyltoluene, m-isopropyltoluene, p-isopropyltoluene, o-n-butyltoluene, m-n-butyltoluene, p-n-butyltoluene, o-t-butyltoluene, m-t-butyltoluene, p-t-butyltoluene, o-phenoxytoluene, m-phenoxytoluene, p-phenoxytoluene, o-chlorotoluene, m-chlorotoluene, p-chlorotoluene, the corresponding bromo and iodo-substituted toluenes, o-nitrotoluene, m-nitrotoluene, p-nitrotoluene, o-toluic acid, m-toluic acid, p-toluic acid, 2-hydroxymethylnaphthalene, 3-hydroxymethylnaphthalene, 4-hydroxymethylnaphthalene, 2-methoxymethylnaphthalene, 3-methoxymethylnaphthalene, 4-methoxymethylnaphthalene, 2-ethoxymethylnaphthalene, 3-ethoxymethylnaphthalene, 4-ethoxymethylnaphthalene, 2-propoxymethylnaphthalene, 3-propoxymethylnaphthalene, 4-propoxymethylnaphthalene, 1,2-dimethylnaphthalene, 1,3-dimethylnaphthalene, 1,4-dimethylnaphthalene, 2-ethylmethylnaphthalene, 3-ethylmethylnaphthalene, 4-ethylmethylnaphthalene, the corresponding alkoxy, chloro, bromo, iodo, nitro-substituted methylnaphthalenes, methylanthracenes, methylphenanthrenes, methylchrysenes, etc., o-toluidine, m-toluidine, p-toluidine, o-methyl-N-methylaniline, m-methyl-N-methylaniline, p-methyl-N-methylaniline, o-methyl-N,N-dimethylaniline, m-methyl-N,N-dimethylaniline, p-methyl-N,N-dimethylaniline, o-methyl-N,N-diethylaniline, m-methyl-N,N-diethylaniline, p-methyl-N,N-diethylaniline, o-methyldiphenylmethane, m-methyldiphenylmethane, p-methyldiphenylmethane, etc. It is to be understood that the aforementioned methyl-substituted aromatic compounds are only representative of the group of compounds which may be employed, and that the present invention is not necessarily limited thereto.

The electrochemical oxidation of the aforementioned methyl-substituted aromatic compounds is accomplished by subjecting said compounds to an electrical energy which includes a direct electric current in the presence of a nucleophile to form acetals, the acetals then being subsequently subjected to acid hydrolysis to form the desired aldehydes. Nucleophiles which may be employed to effect the desired reaction will include organometallic oxides in which the metallic portion of the compound preferably comprises an alkali metal. The metallic portion of the compound in the preferred embodiment of the invention will comprise an alkali metal. Some specific examples of nucleophiles which may be employed in the present invention will possess the generic formula R—O—M in which R may be an alkyl or aryl group and M is a metal, preferably an alkali metal such as sodium methoxide, sodium ethoxide, sodium isopropoxide, sodium t-butoxide, sodium sec-pentoxide, sodium phenoxide, sodium-2-phenylethoxide, sodium-3-phenylpropoxide, sodium-4-phenylbutoxide, sodium-5-phenylpentoxide, lithium methoxide, lithium ethoxide, lithium isopropoxide, lithium t-butoxide, lithium sec-pentoxide, lithium benzoate, lithium phenoate, lithium-2-phenylethoxide, lithium-3-phenylpropoxide, lithium-4-phenylbutoxide, lithium-5-phenylpentoxide, potassium methoxide, potassium ethoxide, potassium isopropoxide, potassium t-butoxide, potassium sec-pentoxide, potassium phenoxide, potassium-2-phenylethoxide, potassium-3-phenylpropoxide, potassium-4-phenylbutoxide, potassium-5-phenylpentoxide, etc. It is to be understood that the aforementioned compounds are only representative of the types of compounds which may be employed, and that the present invention is not necessarily limited thereto.

In addition to the nuclephile, the anodic benzyl oxidation is also effected in the presence of a solvent including aliphatic mono- and diols such as methanol, ethanol, propanol, isopropanol, n-butanol, t-butanol, ethylene glycol, propylene glycol, etc., ketones such as acetone, methyl ethyl ketone, diethyl ketone, ethyl propyl ketone, dipropyl ketone, etc., and mixtures of ketones and alcohols, acetonitrile, methylene chloride, etc.

If so desired, the reaction medium may also include a reaction initiator which will decrease the lag time of the reaction. Some reaction initiator which may be employed will include alkali metal hydroxides such as sodium hydroxide, potassium hydroxide, lithium hydroxide, rubidium hydroxide, cesium hydroxide, etc., quaternary ammonium hydroxides, both symmetrical and asymmetrical in nature, such as tetramethylammonium hydroxide, tetrapropylammonium hydroxide, trimethylbenzylammonium hydroxide, dimethyldibenzylammonium hydroxide, methyltribenzylammonium hydroxide, triethylbenzylammonium hydroxide, diethyldibenzylammonium hydroxide, ethyltribenzylammonium hydroxide, etc., quaternary phosphonium hydroxides such as tetramethylphosphonium hydroxide, tetraethylphosphonium hydroxide, tetrapropylphosphonium hydroxide, etc. It is also contemplated within the scope of this invention that, if so desired, a supporting electrolyte may be present in the reaction mixture in order to increase the conductivity of the medium as well as decreasing the overall operating costs of the reaction. Examples of phase transfer agents which may be employed in addition to the quaternary ammonium and phosphonium hydroxide salts hereinbefore set forth will also include the corresponding sulfate, nitrate, chloride and bromide salts of these quaternary compounds as well as sodium chloride, sodium sulfate, potassium chloride, potassium sulfate, perchlorates, tetrafluoroborates, etc.

The electrochemical cell in which the electrochemical oxidation of the alkyl aromatic compound is effected may be of any variety which is well known in the art. The electrodes which are employed in the cell may be formed of any conductive material such as a carbon anode and stainless steel cathode, a ruthenized titanium dioxide base anode and a copper cathode, a platinum anode and stainless steel cathode, etc., although it is also contemplated that other conductive materials may be employed. The oxidation reaction is effected utilizing an electrical energy which includes a voltage within the range of from about 2 to about 30 volts and/or a current density in the range of from above 0 to about 1000 milliamps/cm$^2$.

The process may be effected in any suitable manner and may comprise either a batch or continuous type operation. When a batch type operation is employed, the electrolyte solution is added to a reservoir along with the particular alkyl aromatic compound which is to undergo electrochemical oxidation. The cell is then subjected to an electrical energy within the range hereinbefore set forth for a predetermined period of time which may range from about 0.5 up to about 10 hours or more in duration. In addition, it is also contemplated within the scope of this invention that the electrochemical cell which is employed to effect the process may comprise a divided cell using an environmentally stable anion exchange membrane to separate the two reservoirs, one reservoir containing the anolyte and the other reservoir containing the catholyte. The anolyte solution containing the alkyl aromatic compound which is to undergo electrochemical oxidation is placed in one reservoir and the catholyte is placed in the second reservoir. When utilizing either a divided electrochemical cell or an undivided electrochemical cell the reaction mixture, after completion of the desired residence time, is withdrawn and subjected to conventional means of separation which may include decantation, washing, drying, fractional distillation, etc., whereby the desired product comprising a mixture of ether and an acetal may be separated from unreacted starting materials and recovered.

The acetal which has been recovered from the prior step is then subjected to an acid hydrolysis step which will convert this compound to the desired aldehyde. The acid hydrolysis is effected by subjecting the product to treatment with an acidic compound at hydrolysis conditions which will include atmospheric pressure and a temperature which may range from about ambient (20°-25° C.) up to about 75° C. The hydrolysis is effected in an appropriate apparatus utilizing, in the preferred embodiment of the invention, a mineral acid such as hydrochloric acid, nitric acid, sulfuric acid, dilute sulfuric acid, or relatively strong organic acids such as formic acid, acetic acid, propionic acid, butyric acid, benzoic acid etc. It is also contemplated within the scope of this invention that the acid hydrolysis may also be effected utilizing an ion exchange resin, such as the Amberlyst resins which are in hydrogen ion form. Following treatment of the acetal for a period of time which may range from about 0.5 up to about 10 hours or more in duration, the desired aldehydic product is separated by conventional means from the acid and/or any unreacted starting materials and recovered.

It is also contemplated within the scope of this invention that the process may be effected in a continuous manner of operation. When such a type of operation is employed, the reaction mixture comprising a basic medium containing a nucleophile and, if so desired, a cosolvent and a reaction initiator may be continuously charged to an electrochemical cell which is maintained at the proper operating conditions of temperature and pressure. After cycling through the cell and being subjected to an electrical charge for a predetermined period of time, the effluent is continuously withdrawn and subjected to conventional means of separation similar to those hereinbefore set forth whereby the desired product comprising the acetal is recovered, while any ether and unreacted alkyl aromatic compounds as well as other components of the medium are recycled.

The acetal which is recovered from the above step is continuously charged to a vessel which will contain an acidic compound of the type hereinbefore set forth in greater detail, said vessel being maintained at the proper operating conditions of temperature and pressure. After contact with the acidic compound for a predetermined period of time, the reactant effluent is continuously withdrawn and subjected to conventional means of separation whereby the desired aldehydic compound is separated from the acid component of the reaction mixture and recovered, while the aforementioned acidic compound and any unreacted acetal is recycled to the reaction zone.

By varying the time parameters during which the electrochemical process is carried out, it is possible to obtain a predominance of either one or the other of the two components of the reaction product. For example, when operating the process for a relatively short period of time with the rate of conversion going up to about 40%, it is possible to obtain a high selectivity of the ether product. Conversely, by operating the process for a relatively long period of time and running to a 100% conversion of the alkyl aromatic compound, it is possible to obtain a high selectivity to the acetals.

Inasmuch as an aldehyde will comprise the desired product of the present invention, it is desirable that the electrochemical process be effected for a period of time sufficient to transfer 4 electron equivalents through the solution in order to insure the aforementioned high selectivity to the acetals, these compounds then being converted to the desired aldehydes in a relatively economical and simple acid hydrolysis step.

The following examples are given to illustrate the process of this invention. However, it is to be understood that these examples are given merely for purposes of illustration and that the present invention is not necessarily limited thereto.

EXAMPLE I

To illustrate the necessity for the presence of a basic medium in which the electrochemical oxidation of the present process is effected, an experiment was run in which sodium methoxide was prepared in situ by adding a sufficient amount of metallic sodium to 90 grams of methyl alcohol to form 10 grams of sodium methoxide. Following the addition of the sodium to the methyl alcohol, 20 grams of p-methoxytoluene were added to the solution which was placed in the reservoir of an electrochemical cell. The cell had a surface area of 50 $cm^2$ with a copper cathode and a platinum anode, said electrodes being spaced at a distance of 13.0 mm. The solution was recycled to the reservoir and the electrical energy which ranged from 6.0 to 7.0 volts at 2.0 amps was actuated. At the end of a 30 minute reaction period, the system was drained, rinsed with methanol, and an internal standard, normal octane, was added. The solution was then subjected to gas-liquid chromatographic analysis which showed that there was no sign of any product formation.

When the experiment was repeated using a lesser concentration of in situ prepared sodium methoxide, the same result was obtained, namely no oxidized product was obtained.

EXAMPLE II

In this example, 90 grams of methanol and 4 grams of sodium methoxide, which contained some sodium hydroxide to afford a basic medium, along with 20 grams of p-methoxytoluene were placed in an electrochemical cell similar in nature to that set forth in Example I above, the only difference being that the anode comprised a titanium dioxide/ruthenium dioxide DSA electrode. A similar procedure was effected using an electrical energy of from 9.5 to 12.0 volts at 2.0 amps, said reaction being effected during a period of 9 hours. At the end of this period, the product was treated in a manner similar in nature to that set forth hereinbefore, it being determined that there was a 16.7% selectivity to p-anisaldehyde methyl ether and a 51.9% selectivity to p-anisaldehyde dimethyl acetal, the current efficiency being 97% with a 96.0% conversion. It was also determined that the ratio of ether to acetal ranged from 97:3 at the beginning of the test to 23:76 at the end of the test.

The p-anisaldehyde dimethyl acetal which was prepared according to the above paragraph was converted to anisaldehyde by placing 5.0 grams of acetal, 5.0 grams of water, and 0.5 grams of an ion exchange resin, sold under the trade name Amberlyst 15, in a flask and stirring the mixture at ambient temperature and atmospheric pressure for a period of 15 minutes. At the end of the 15 minute period, the solution was added to a separatory funnel and, after separation of the organic phase and the aqueous phase, the former was withdrawn. The organic layer was analyzed by means of gas-liquid chromatography and found to contain about 100% anisaldehyde, no methyl alcohol or acetal being determined by this analysis. The aqueous phase had adsorbed the methyl alcohol, thus contributing to the ease of separation of the desired aldehyde product.

EXAMPLE III

In this example, 90.0 grams of methyl alcohol, along with 11 grams of sodium methoxide, which contained some sodium hydroxide, 23 grams of p-methoxytoluene and 2.0 grams of a co-solvent comprising water, were treated in an electrochemical cell similar in nature to that set forth above. The electrical energy which was supplied to the cell ranged from 9.0 to 12.0 volts at 2.0 amps. At the end of the 7 hour reaction period, gas-liquid chromatographic analysis of the product determined that there had been a 19.6% selectivity to p-anisaldehyde methyl ether and a 37.2% selectivity to p-anisaldehyde dimethyl acetal, there being a 58.1% conversion of p-methoxytoluene with a current efficiency of 62.1%.

The p-anisaldehyde dimethyl acetal which had been prepared in the above paragraph may then be converted to the desired aldehyde by mixing equal quantities of the aldehyde and an aqueous solution of hydrochloric acid in an appropriate flask at ambient temperature and atmospheric pressure. Following the expiration of the reaction time, the aqueous layer and the organic layer may then be separated utilizing a separatory funnel, and the desired aldehyde may then be recovered.

EXAMPLE IV

In this example, the selectivity as a function of time was illustrated by subjecting a mixture comprising 90 grams of methyl alcohol, 2 grams of sodium methoxide, which contained some sodium hydroxide, 10 grams of normal octane and 20 grams of p-methoxytoluene to an electrical energy which included 14.0 volts at 2.0 amps. The reaction was effected for a period of 4 hours at room temperature, at the end of which time a gas-liquid chromatographic analysis was run on the product. After subjecting the product to a treatment similar to that set forth in Example I above, 10 grams of normal octane were added with a second gas-liquid chromatographic analysis to determine the product to internal standard ratio. It was determined that there had been a 55% conversion of the p-methoxytoluene with a current efficiency of 117.54%. A sample taken at an early period showed a 70.5:8.3 ratio of ether to acetal which dropped to a ratio of 53.9:18.1 at a later period in time. Thus, it is shown that the shorter period of reaction time and lower conversion percentage results in the obtention of a greater amount of p-anisaldehyde methyl ether than p-anisaldehyde dimethyl acetal.

The conversion of the acetal to the desired anisaldehyde may be accomplished by treating the acetal with an aqueous nitric acid solution at ambient temperature and atmospheric pressure in a manner similar to that hereinbefore set forth and the desired aldehyde may then be recovered therefrom.

EXAMPLE V

This example illustrates the effect of running to high conversion on the overall selectivity and product distribution which is obtained. Again, 95 grams of methyl alcohol, 2 grams of sodium methoxide containing some sodium hydroxide to afford a basic medium, and 20 grams of p-methoxytoluene were subjected to an electrical energy which ranged from 12.0 to 13.0 volts at 2.0 amps, said electrochemical oxidation being effected in a cell similar in makeup to that hereinbefore set forth. A gas-liquid chromatographic analysis of the product determined that there had been a 75% conversion with a current efficiency of 109%. The selectivity to ether at this high conversion was 34.8% and the selectivity to the acetal was 42.5%. Samples taken during the run showed an initial ether to acetal ratio of 91.6:6.7, while the ratio dropped at the end of the reaction to 46.4:50.0. Thus, it is shown that when running the reaction at a high conversion rate, it is possible to alter the product distribution and obtain a greater amount of p-anisaldehyde dimethyl acetal.

Following the formation of the acetal, it may then be converted to the desired aldehyde by treating the acetal with Amberlyst 15 in a manner similar to that set forth in Example II above, and recovering the desired aldehyde.

EXAMPLE VI

In this example, 94 grams of methyl alcohol, along with 2.2 grams of sodium methoxide containing some sodium hydroxide, 20 grams of p-methoxytoluene and 4 grams of tetramethylammonium hydroxide were subjected to an electrochemical reaction similar to that hereinbefore set forth. The reaction was effected for a period of 4 hours using an electrical energy which included from 4.5 to 6.5 volts at 2.0 amps. A gas-liquid chromatographic analysis of the product showed that there had been a 52.0% conversion at a current efficiency of 68.7%. The selectivity amounted to 50.5% ether and 23.1% acetal.

The acetal which has been prepared according to the above paragraph may then be converted to the aldehyde by treating said acetal with a dilute sulfuric acid solution under conditions similar to those hereinbefore set forth. Upon completion of the desired residence time, the organic layer and the aqueous layer may be separated and the desired aldehyde recovered therefrom.

EXAMPLE VII

In a manner similar to that set forth in the above examples, a solution containing 20 grams of p-methoxytoluene, 90 grams of ethyl alcohol and 2 grams of potassium ethoxide which contains some potassium hydroxide may be placed in the reservoir of an electrochemical cell which is similar in nature to those hereinbefore set forth. An electrical energy may be applied to the cell using an applied voltage of from 10 to about 14 volts at 20 amps while maintaining the current density at about 50 milliamps/cm$^2$. Upon completion of a 6 hour reaction period, the desired product comprising a mixture of p-anisaldehyde ethyl ether and p-anisaldehyde diethyl acetal may be recovered therefrom.

As in the above examples, the acetal which has been obtained utilizing the method set forth in the above paragraph may be converted to the desired aldehyde by treating said acetal with water in the presence of Amberlyst 15 at reaction conditions including ambient temperatures and atmospheric pressure. After treating the acetal for a predetermined period of time, the reaction mixture may be allowed to separate and the desired aldehydes may be recovered from the organic phase.

We claim as our invention:

1. A process for the preparation of an aromatic aldehyde comprising subjecting a methyl-substituted aromatic compound to an electrical energy including direct electric current in an electrochemical cell in the presence of a nucleophile consisting essentially of an organometallic oxide representative of:

R—O—M wherein R is either an alkyl or an aryl moiety and M is an alkali metal selected from the group consisting of sodium, lithium and potassium; in the presence of a solvent consisting essentially of an aliphatic alcohol, an aliphatic diol, a ketone, or mixtures thereof; and in the presence of a reaction initiator selected from the group consisting of an alkali metal hydroxide and a quaternary ammonium hydroxide, at reaction conditions to produce an acetal and thereafter subjecting said acetal to said hydrolysis to produce said resultant aromatic aldehyde, which is recovered.

2. The process as set forth in claim 1 in which said electrical energy includes a voltage in the range of from about 2 to about 30 volts at a current density in the range of from above 0 to about 1000 milliamps per square centimeter.

3. The process as set forth in claim 1 in which said reaction conditions include a temperature in the range of from about ambient to about 50° C. and atmospheric pressure.

4. The process as set forth in claim 1 in which said reaction initiator is sodium hydroxide.

5. The process as set forth in claim 1 in which said reaction initiator is potassium hydroxide.

6. The process as set forth in claim 1 in which said reaction initiator is ammonium hydroxide.

7. The process as set forth in claim 1 in which said nucleophile is sodium methoxide.

8. The process as set forth in claim 1 in which said nucleophile is potassium ethoxide.

9. The process as set forth in claim 1 in which said aliphatic is methyl alcohol.

10. The process set forth in claim 1 in which said methyl-substituted aromatic compound is p-methoxytoluene, said nucleophile is sodium methoxide and said aldehyde is p-anisaldehyde.

11. The process as set forth in claim 1 in which said methyl-substituted aromatic compound is p-ethoxytoluene, said nucleophile is potassium ethoxide, and said aldehyde is p-ethoxybenzaldehyde.

12. The process as set forth in claim 1 in which said methyl-substituted aromatic compound is 1-methyl-4-methoxynaphthalene, said nucleophile is sodium methoxide, and said aldehyde is 4-methoxynaphthaldehyde.

* * * * *